United States Patent [19]

Blumenthal et al.

[11] 4,008,578

[45] Feb. 22, 1977

[54] PIT PROP ASSEMBLY

[75] Inventors: Günter Blumenthal, Westerholt; Peter Marr, Bochum, both of Germany

[73] Assignee: Bochumer Eisenhutte Heintzmann & Company, Bochum, Germany

[22] Filed: May 11, 1976

[21] Appl. No.: 685,162

[30] Foreign Application Priority Data

May 17, 1975 Germany ..... 2522111

[52] U.S. Cl. ..... 61/45 D

[51] Int. Cl.[2] ..... E21D 15/44

[58] Field of Search ..... 61/45 D; 299/31–33; 248/357; 91/170 MP

[56] References Cited

UNITED STATES PATENTS

| | | | |
|---|---|---|---|
| 3,174,289 | 3/1965 | Rosenberg | 61/45 D |
| 3,197,965 | 8/1965 | Lee et al. | 61/45 D |
| 3,435,620 | 4/1969 | Weirich et al. | 61/45 D |
| 3,628,335 | 12/1971 | Behr | 61/45 D |
| 3,813,886 | 6/1974 | Alacchi | 248/357 |
| 3,896,626 | 7/1975 | Spies et al. | 61/45 D |
| 3,949,562 | 4/1976 | Blumenthal et al. | 61/45 D |

FOREIGN PATENTS OR APPLICATIONS

| | | | |
|---|---|---|---|
| 2,013,634 | 11/1970 | Germany | 61/45 D |

*Primary Examiner*—Dennis L. Taylor
*Attorney, Agent, or Firm*—Michael J. Striker

[57] ABSTRACT

A pit prop assembly for use in a mine having a floor, a roof, and a face, comprises a pair of pit props having parallel elongated floor-engaging bases on each of which is pivoted a roof-engaging arm which may be pressed against the roof by means of a hydraulic ram extending vertically between each base and the respective arm. A pair of telescoping elements extend longitudinally between these two bases and one of the elements is pivoted at its front and rear end on respective front and rear end of one of the bases and the other element pivoted at its front and rear end on the respective front and rear end of the other base. A longitudinal-displacement ram is provided between these telescoping elements so that the two pit props can be displaced longitudinally relative to each other. In addition a transverse ram forms the connection between the rear of one of the elements and the corresponding rear of the corresponding base so that transverse displacement or swiveling of the two pit props is also possible.

10 Claims, 8 Drawing Figures

4
13
14
12
3
1
6
11
5
2
II
15
16
9
16
10
II
7
8

T
11
24
8
7
6
10
8
11
26a
42a
28a
28a
27b
III
20
27a
30
18
29
28b
IV
22
V
26c
28c
42b
20
23
29
21
32
31
IV
7
42c
11
33
L
42d
6
7
11

PIT PROP ASSEMBLY

CROSS REFERENCE TO RELATED APPLICATIONS

This application is related to my copending patent applications Ser. No. 477,084 (now U.S. Pat. No. 3,949,562), Ser. No. 543,369 (now U.S. Pat. No. 3,959,976), Ser. No. 618,212 (now U.S. Pat. No. 3,961,487), and filed June 6, 1974, Jan. 23, 1975, Sept. 30, 1975, and now commonly herewith, respectively.

BACKGROUND OF THE INVENTION

The present invention relates to a pitprop assembly. More particularly this invention concerns such an assembly used to hold up the roof of a mine during working of the face thereof.

In a conventional mine, a face conveyor or a guide for a coal plow or the like is normally secured to a succession of pit props which are braced between the floor and roof of the mine and serve to prevent the roof from caving in. As the face is dug away and the useable coal or ore is displaced out of the mine with the waste or tailings displaced backwardly behind the pit props, it is necessary to move these pit props toward the face. In most common arrangements each pit prop is connected via a respective hydraulic cylinder to the face conveyor. Thus the ram which presses the roof shield against the mine roof is relaxed and the displacement ram itself is operated in order to drag the pit prop toward the conveyor. During such displacement of one pit prop the other props are maintained tightly in place to hold the conveyor stationary in order that it provide a solid pulling support for the prop being moved. In this manner it is possible to move the props forward one-by-one.

Such a system has the considerable disadvantage that it places a considerable strain on the face conveyor, guide or other element functioning as a support which is provided at the face. In particular, it is not a rare occurrence that the pit prop being moved becomes jammed so that it cannot move and instead the conveyor or support is pulled toward the jammed pit prop, thereby damaging this element. It has been suggested to use a separate support beam that extends between three or more such pit props so as to eliminate this potential damage to the conveyor, but such an arrangement only increases the cost and complexity of the system.

Another considerable disadvantage of this system is that it usually establishes a fixed spacing between the pit props. Thus it is impossible to compensate for local conditions by varying the prop spacing. Furthermore, each prop can only be displaced when connected to a support or when winched or pushed into place by means of a tractor. Another disadvantage of the known systems is that it is impossible to move the pit props in a direction parallel to the face without the use of a separate winch or tractor.

SUMMARY OF THE INVENTION

It is therefore an object of the present invention to provide an improved pit prop assembly.

Another object is the provision of such an assembly which can move without stressing the face conveyor or other support.

A further object is to provide a pit prop assembly which can move to at least a limited extent parallel to the face.

These objects are attained according to the present invention in an arrangement wherein a pair of pit props each comprising a floor-engaging base and a roof-engaging arm are interconnected by a hydraulic ram which extends in the longitudinal direction of the bases, that is perpendicular to the face, and has one end connected to one of the bases and another end connected to the other base. Such a ram can therefore be contracted or expanded to displace one of the props relative to the other toward or away from the face.

In accordance with another feature of this invention means is provided to maintain the front or the rear ends of the bases at a predetermined lateral spacing while permitting relative longitudinal displacement of them, and means is provided at the opposite end of these bases for varying the spacing between them. This makes it possible to cant the one base relative to the other and, therefore, to walk the pit prop in a direction parallel to the face.

With the system according to the present invention it is therefore readily possible to couple a power hose to a pit prop assembly comprising a pair of props and have it move itself independently of any other structure in the mine. Simple straightforward and backward movement is effected by bracing one prop between the roof and floor and then expanding or contracting the longitudinal ram to displace the other prop in the appropriate direction parallel to the fixed prop, and then to reverse this procedure with the other prop. In order to go around a corner the transverse ram is actuated to cant the two props relative to each other while the one prop is fixed so that the bases can be aligned in the desired direction before longitudinal displacement is effected. In this manner it is indeed possible to turn the prop completely around in a relatively small area without the necessity of providing external winches or using a tractor.

According to further features of the present invention a pair of telescope members are provided, one of which is connected by a pair of pivots defining a longitudinal pivot axis to one of the base and the other of which is connected only by one pivot to the other base. The longitudinal displacement ram is effective between these two members and the transverse displacement ram is effective between the other member and the other base.

The pivot interconnecting these various elements and, indeed, connecting the transverse ram to the other member and the other base may be formed as a ball-and-socket joint in order to permit limited canting of the various elements relative to each other or may be formed of one part having a throughgoing hole of hyperboloidal or double-flared shape in which fits another element of generally cylindrical shape. Thus with this system it is possible for the one base to lie above or below the other or even at an angle to the other.

In accordance with yet another feature of this invention a guide is provided on one base defining a pivot axis generally parallel to the longitudinal base direction and a pivot is provided on the other base. A traverse extending transverse to the direction is carried on this pivot and extends toward the one base and an axle extends from this transverse in the longitudinal direction along the axis through the guide. The ram therefore has its one end connected to this traverse and its other end connected to the one base so that by expansion or contraction it can displace the two bases relative to each other in the longitudinal direction.

According to yet another feature of this invention a flexible element such as a cable or chain has one end connected to one of the bases and another end passing over a deflecting roller or sprocket and connected to a ram on the other base. The contraction of this ram can therefore pull the corresponding ends of the bases together. These ends can be rushed apart by means of hydraulic cylinders provided on the arms of the base which are used for positioning of the roof shield.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

SPECIFIC DESCRIPTION OF THE PREFERRED EMBODIMENTS

Figure 1:
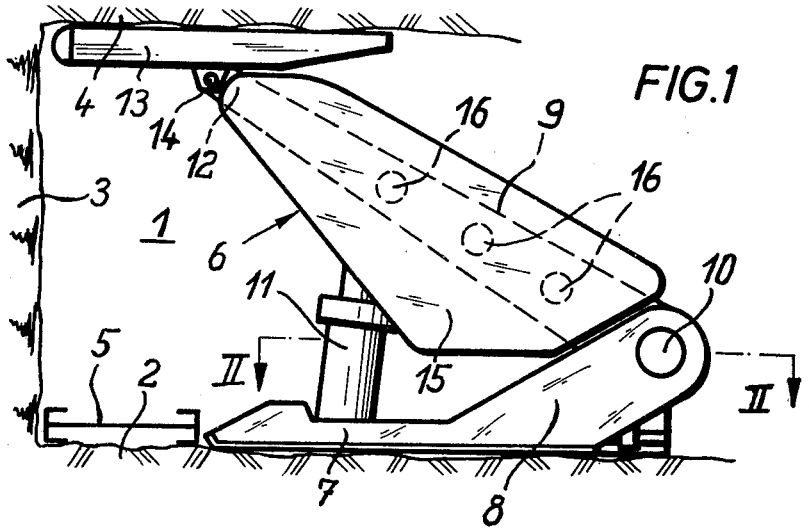
FIG. 1 is a vertical section through a mine showing a pit-prop assembly according to this invention in side view.
Figure 2:
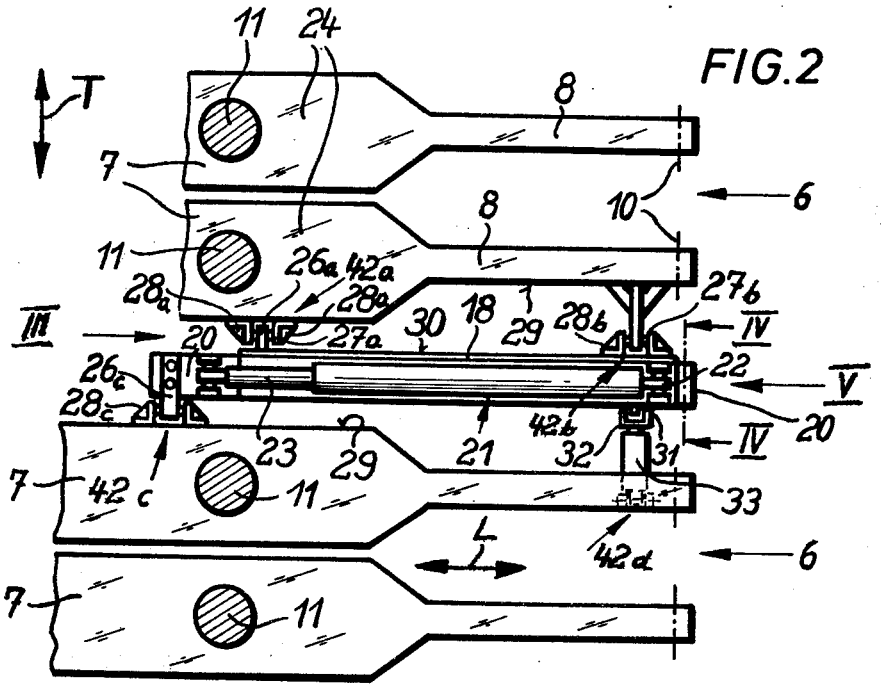
FIG. 2 is a section taken along line II—II of FIG. 1.

As shown in FIGS. 1 and 2, a mine 1 has a floor 2, a face 3, and a roof 4. A face conveyor 5 extends parallel to the face 3 in a direction T and is adapted to carry a coal plow or the like.

A pair of pit props 6 together forming a pit prop assembly each have a base 7 with a raised rear end 8 on which is pivoted a roof-engaging arm 9 about a horizontal pivot 10 extending in the direction T. The base 7 and arm 9 both extend in the longitudinal direction indicated by double-headed arrow L in FIG. 2. Each such prop 6 further has a heavy-duty hydraulic ram 11 extending between the front portion of the base arm 7 and roof-engaging arm 9. The arm 9 has a telescoping section 12 carrying a roof-engaging shield 13 pivotal about an axis 14 parallel to the direction T. In addition this arm 9 has lateral plates or cheeks 15 whose spacing in the direction T can be determined by rams 16 expansible in the direction T to force these plates 15 apart or pull them together. The rear section 8 of each of the bases 7 is at most half as wide as the front portions of the bases 7.

Figure 3:
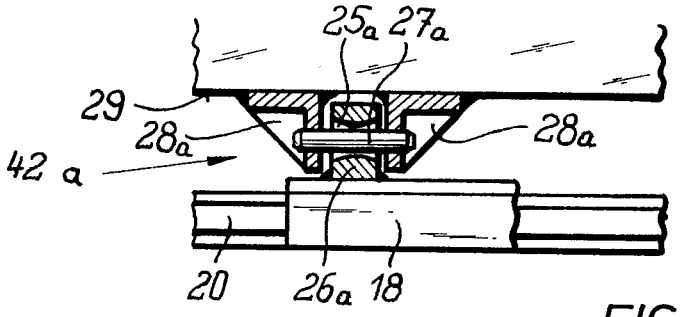
FIG. 3 is a view taken in the direction of arrow III of FIG. 2.
Figure 4:
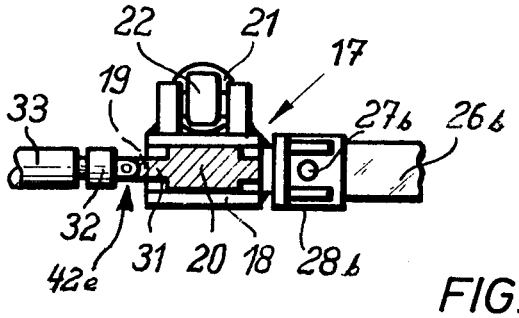
FIG. 4 is a section taken along line IV—IV of FIG. II.
Figure 5:
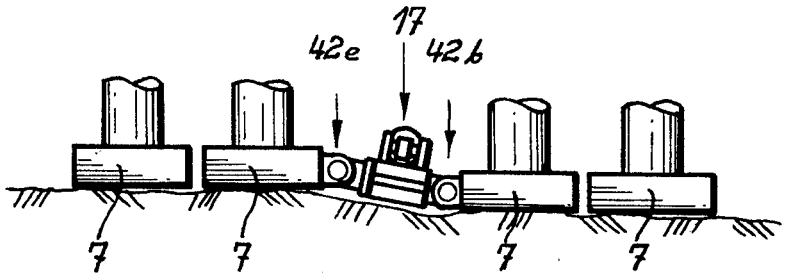
FIG. 5 is a view taken in the direction of arrow V of FIG. 2.

As show in greater detail in FIGS. 3 – 5 there is provided between each adjacent pair of props 6 a displacement assembly 17 basically comprising an outer element 18 and an inner element 20 telescoped to each other in the direction L. The element 20 is of cruciform section and the element 18 has a correspondingly shaped throughgoing passage in which the element 20 fits so that this element 20 cannot twist relative to the element 18. A longitudinal-displacement ram 21 has a rear end pivoted at 22 on the outer element 18 and a piston rod 23 pivoted at the front end of the assembly on the inner element 20. Thus expansion and contraction of this double-acting cylinder 21 can telescope the elements 18 and 20 relative to each other.

The front end of the outer element 18 is connected via a joint 42*a* to the front portion of one of the bases 7. This joint 42*a* comprises as best shown in FIG. 3 a heavy lug 26*a* mounted on the element 18 and formed with a hyperboloidal or double-flared throughgoing hole 25*a* in which fits a cylindrical pin 27*a* extending between two lugs 28*a* secured to the inner face 29 of the front portion of the base 7. Such a joint therefore defines a generally horizontal pivot axis parallel to the direction L but also allows limited canting of the elements 18 and 7 relative to each other.

The rear end of the element 18 is secured via a joint 42*b* which is substantially identical to the joint 42*a*, but formed of an elongated outrigger arm or lug 26*b* shown also in FIG. 4 and engage between a pair of shorter lugs 28*b* between which passes a short cylindrical pin 27*b* identical to the pin 27*a*.

The front end of the inner element 20 is connected via another such a joint 42*c* comprising an outrigger lug 26*c* carried on the front end of the element 20 and pivoted between a pair of lugs 28*c* pivoted to the inner face 29 of the other base 7.

The inner element 20 is formed with a laterally projecting arm 31 that extends through a slot 19 in the side of the element 18. A short transverse ram 33 extending in the direction T transverse to the longitudinal direction L has its cylinder secured by means of a pivot 42*d* substantially identical to the pivots 42*a–c* on the rear end of the other base 7 and has a piston rod 32 secured to this arm 31 by means of another such pivot 42*e*.

The provision of these pivots 42*a–e* allows each base 7 of each assembly as shown in FIG. 5 to be vertically offset from the other base 7 of the other pit prop. The two bases 7 need not be strictly parallel to each other either as limited canting of these two elements is possible due to the swiveling action of the joints 42*a–e*.

In order to move one pit prop in the direction L relative to the other one of the cylinders 11 is relaxed in order to drop down the shield 13. Then the cylinder 21 is either expanded or contracted to drag the pit prop in the appropriate direction L. In order to turn a corner or to position the two props 6 laterally relative to each other the cylinder 33 can be operated to displace the rear ends 8 away from each other. If one of the pit props is locked in place between the roof 4 and floor 2 and the other is not, this cylinder 33 can displace the latter prop transversely. Then if the ram 11 of this pit prop which has just been moved is actuated to tighten it against the ceiling and the other ram 11 is released it is possible to pull the other pit prop into line with it. Thus, the arrangement can even be made to move around corners and can be made to walk along no-straight paths to the face 3. There is no need to connect the pit prop assembly to the conveyor 5 and the lateral spacing between adjacent assemblies can be varied.

Figure 6:
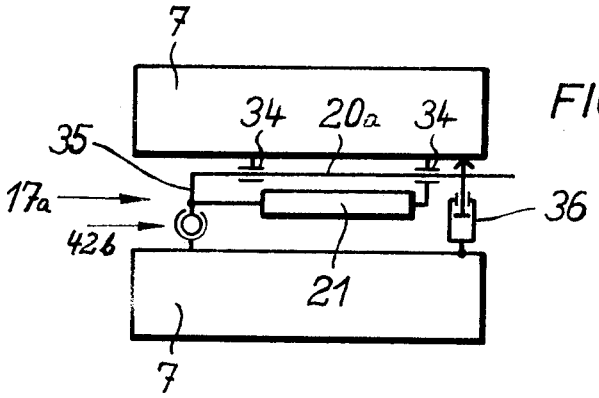
FIGS. 6, 7 and 8 are top schematic views illustrating other assemblies in accordance with this invention.

It is also possible as shown in FIG. 6 to provide a ball-and-socket joint 42*f* on the one base 7 and connected to a traverse 35 on which is mounted a pivot rod 20*a* passing through two in-line pivots 34 on the other base 7. A transverse ram 36 engages directly between the rear ends of the two bases 7 and a longitudinal-displacement cylinder 21 has its front end secured to the traverse 35 and its rear end to one of the pivots 24. Thus a displacement assembly 17*a* is produced which can perform all of the functions of the assembly 17 shown in FIGS. 1 – 5. The ends of the cylinder 36 are pivoted on the two bases 7 and the cylinder 21 is provided between the two bases 7.

Figure 7:
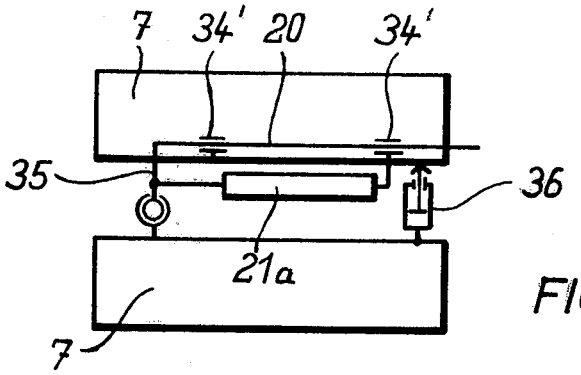
Figure 8:
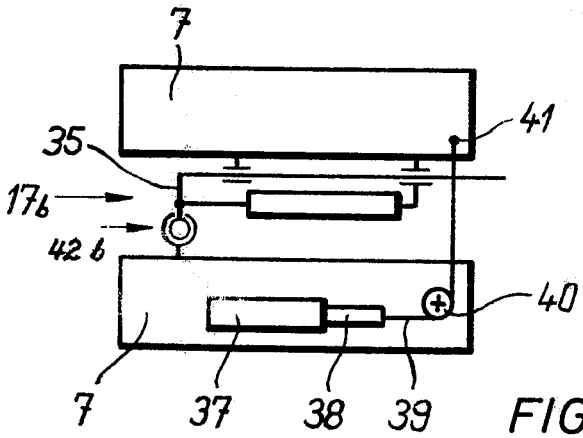

FIG. 7 shows an arrangement substantially identical to FIG. 6, but wherein the two pivots 34 are replaced by pivots 34' provided within the one base 7. Finally FIG. 8 shows an arrangement 17*b* substantially identical to the assembly 17*a* of FIG. 6, but wherein the cylinder 36 is replaced by a cylinder 37 extending longitudinally in one of the bases 7 and having a piston rod 38 secured to a cable 39 passing by 90° around an idler roller or sprocket 40 and having its other end secured to the other base 7. Thus contraction of the cylinder 37 can pull the rear ends of the two bases 7 toward each other in the transverse direction. The two pit props 6 can be pushed apart by means of the cylinders 16.

It will be understood that each of the elements described above, or two or more together may also find a useful application in other types of structures differing from the types described above.

While the invention has been illustrated and described as embodied in a pit prop assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims.

1. A pit prop assembly for use in a mine having a floor, a roof, and a face, said assembly comprising: a pair of pit props having parallel elongated floor-engaging bases each with a front end adapted to be turned toward said face and a rear end turned away from said face and spaced in the longitudinal direction of the respective base from the respective front end, a roof-engaging arm pivoted on each of said bases at the respective rear end thereof, and means between each of said arms and the respective base for pressing the respective arm against said roof; a longitudinal hydraulic ram extending in said direction and having one end operatively connected to one of said bases and another end operatively connected to the other of said bases, whereby longitudinal contraction or extension of said ram displaces said bases relative to each other in said direction; and means including an element of variable length between said bases for varying the spacing transverse to said direction therebetween.

2. The assembly defined in claim 1, further comprising a pair of members telescoped in each other, a pivot defining a longitudinal pivot axis between each of said ends of said one base and one of said members and between one of said ends of said other base and the other member, said ram being connected between said members.

3. The assembly as defined in claim 2 wherein said means includes a transverse ram operatively connected between the other end of said other base and said other member.

4. The assembly defined in claim 2 wherein said one of said elements is of nonround section and the other element has a passage of similar nonround section.

5. The assembly defined in claim 2 wherein each of said pivots includes a part having a throughgoing hole of hyperboloidal shape and a pin of generally cylindrical shape received in said hole and limitedly cantable therein.

6. The assembly defined in claim 1 wherein said means is a transverse ram operatively engaged between said rear ends.

7. The assembly defined in claim 1 wherein said means includes a flexible element having an outer end secured to said one base and an inner end at said other base, and a hydraulic ram on said other base connected to said inner end.

8. The assembly defined in claim 1 wherein said ram lies between said bases.

9. The assembly defined in claim 1, further comprising a guide on said one base defining a pivot axis generally parallel to said direction, a pivot on said other base, a traverse extending transverse to said direction carried on said pivot and extending toward said one base, and an axle extending from said transverse in said direction along said axis and lying in said guide, said ram having its said one end connected to said traverse and its said other end connected to said one base.

10. The assembly defined in claim 9 wherein said guide lies within said one base, said means being a transverse ram engaged between said rear ends of said bases.

* * * * *